US011212618B2

(12) United States Patent
Yan et al.

(10) Patent No.: US 11,212,618 B2
(45) Date of Patent: Dec. 28, 2021

(54) VIBRATION SOUNDING DEVICE

(71) Applicant: AAC Technologies Pte. Ltd., Singapore (SG)

(72) Inventors: Xudong Yan, Shenzhen (CN); Keyong Zhou, Shenzhen (CN); Wei Liu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 30 days.

(21) Appl. No.: 16/930,287

(22) Filed: Jul. 15, 2020

(65) Prior Publication Data

US 2021/0021935 A1 Jan. 21, 2021

(30) Foreign Application Priority Data

Jul. 16, 2019 (CN) ..... 201921119006.5

(51) Int. Cl.

| | |
|---|---|
| ***H04R 9/06*** | (2006.01) |
| ***H04R 9/02*** | (2006.01) |
| ***H04R 9/04*** | (2006.01) |
| ***H04R 7/04*** | (2006.01) |

(52) U.S. Cl.

CPC ..... *H04R 9/06* (2013.01); *H04R 7/04* (2013.01); *H04R 9/025* (2013.01); *H04R 9/046* (2013.01); *H04R 2400/03* (2013.01); *H04R 2400/11* (2013.01); *H04R 2499/11* (2013.01)

(58) Field of Classification Search

CPC ..... H04R 9/06; H04R 9/025; H04R 9/046; H04R 7/04; H04R 2499/11; H04R 2400/11; H04R 2400/03; H04R 31/006

See application file for complete search history.

(56) References Cited

U.S. PATENT DOCUMENTS

| | | | | |
|---|---|---|---|---|
| 6,600,938 | B1 * | 7/2003 | Suzuki | B06B 1/045 455/567 |
| 6,873,234 | B2 * | 3/2005 | Kyouno | G10K 9/20 335/278 |
| 2019/0151896 | A1 * | 5/2019 | Takahashi | H04M 1/026 |
| 2019/0334076 | A1 * | 10/2019 | Kim | H02N 2/021 |

* cited by examiner

*Primary Examiner* — Tuan D Nguyen
(74) *Attorney, Agent, or Firm* — W&G Law Group

(57) ABSTRACT

A vibration sounding device includes a panel, and an electromagnetic driver attached to the panel and configured to drive the panel to vibrate and sound. The electromagnetic driver includes a housing, a driving unit received in the housing, and a cover. The cover is attached to the panel. The driving unit includes a coil assembly mounted to the cover and a pair of magnet assemblies mounted to the housing. The coil assembly includes a coil defining an axial direction around which the coil is wound. The pair of magnet assemblies is located at opposite sides of the coil assembly with gaps formed therebetween in the axial direction. The electromagnetic driver includes a first elastic member configured to support the coil assembly in the housing. The first elastic member is connected between the coil assembly and the housing and configured to provide an elastic supporting force for the coil assembly.

16 Claims, 5 Drawing Sheets

VIBRATION SOUNDING DEVICE

FIELD OF THE INVENTION

The present disclosure relates to the field of electroacoustic conversion, and in particular to a vibration sounding device used in a portable mobile terminal.

BACKGROUND

With the advent of the mobile internet era, the number of intelligent mobile devices continues to increase. Among the mobile devices, mobile phones are undoubtedly the most common and most portable mobile terminal devices. At present, the functions of mobile phones are very diverse, and one of them is the high-quality music function. With the growing demand for larger screen space available for user operation and better acoustic performance of the mobile phones, screen sounding technology has become a trend in the mobile phone industry.

A vibration sounding device in the related art comprises a screen and a driver configured to drive the screen to vibrate and sound.

However, the vibration sounding devices in the related art generally adopt piezoelectric-type drivers, moving coil type drivers or electromagnetic type drivers. The piezoelectric-type driver requires a large voltage, which means the mobile terminal needs to adjust the battery arrangement and the cost is therefore increased. The moving coil type drivers have limited driving forces which limit the acoustic performance of the mobile terminals. Although the electromagnetic type driver of the related art can meet the driving force requirements, it makes the screen subject to a great suction force and imposes a high assembly requirement for the screen and middle frame of the mobile terminal, which reduces the reliability and assembleability of the screen.

Therefore, there is a desire to provide an improved vibration sounding device which overcomes the above problems.

SUMMARY

Accordingly, the present disclosure is directed to a vibration sounding device with improved acoustic performance and reliability.

In one aspect, the present disclosure provides a vibration sounding device comprising a panel and an electromagnetic driver attached to the panel and configured to drive the panel to vibrate in a vibrating direction and sound. The electromagnetic driver comprises a housing, a driving unit disposed in the housing, and a cover covered on the driving unit, one of the housing and the cover being attached to the panel. The driving unit comprises a coil assembly mounted to the cover and at least one pair of magnet assemblies mounted to the housing. The coil assembly comprises a coil defining an axial direction around which the coil is wound. The at least one pair of magnet assemblies is located at opposite sides of the coil assembly with gaps formed therebetween in the axial direction. The electromagnetic driver comprises a first elastic member configured to support the coil assembly in the housing. The first elastic member is connected between the coil assembly and the housing and configured to provide an elastic supporting force for the coil assembly.

In some embodiments, the housing comprises a bottom plate and a side wall extending from the bottom plate toward the cover and around the driving unit, and the first elastic member comprises a first fixing arm attached to the coil assembly, a second fixing arm attached to the side wall and an elastic connecting arm connected between the first fixing arm and the second fixing arm, the elastic connecting arm being spaced from the bottom plate in the vibrating direction.

In some embodiments, an orthographic projection of the elastic connecting arm in the vibrating direction is spaced from an orthographic projection of the magnet assembly in the vibrating direction.

In some embodiments, the first elastic member is U-shaped.

In some embodiments, the electromagnetic driver further comprises a second elastic member connected the cover with the housing, the second elastic member comprising a frame and connecting parts, the frame comprising a pair of first elastic arms facing each other and a pair of second elastic arms connected between ends of the first elastic arms, the first elastic arms mounted on opposite sides of the housing, at least one of the connecting parts being arranged on a side of each of the second elastic arms away from the housing, the second elastic arms being secured to the cover via the connecting parts.

In some embodiments, a surface of the bottom plate facing the cover defines a recess which is sunk from the surface in a direction away from the cover, the second fixing arm being attached to a surface of the side wall facing the coil assembly, the magnet assembly being mounted on the bottom plate and located at opposite sides of the recess, an orthographic projection of the coil in the vibrating direction toward the bottom plate falling within a periphery of the recess.

In some embodiments, portions of the side wall protrude toward the cover to form a pair of support parts, and the first elastic arms are supported and fixed on the support parts respectively.

In some embodiments, the axial direction is perpendicular to the vibrating direction.

In some embodiments, the coil assembly further comprises an iron core and the coil is wound on the iron core.

In some embodiments, wherein the coil assembly further comprises a mounting member configured to mount the coil to the cover and a clamping member disposed between the coil and the cover.

In some embodiments, the mounting member comprises a bottom plate, a pair of side walls extending from opposite sides, adjacent to the magnet assemblies, of the bottom plate toward the cover, and a pair of top walls extending in opposite directions from top ends of the side walls away from the bottom plate, the bottom plate and the side walls cooperatively forming a receiving space, the top walls contacting and being fixed to the cover, the coil being fixed in the receiving space, the first fixing arm being fixed to a side of the bottom plate away from the coil.

In some embodiments, the mounting member comprises a pair of fixing plates fixed to opposite sides of the coil close to the magnet assemblies and fixing protrusions extending from the fixing plates toward the cover, cutouts are formed in opposite sides of the clamping member, and the fixing protrusions are respectively engaged in the cutouts and fixed to the cover.

In some embodiments, the end plate has a rectangular shape, the side wall comprises a pair of first side plates and a pair of second side plates connected between the first side plates, the recessing extending from one of the second side plates to the other of the second side plates, an orthographic projection of the first elastic member in the vibrating direction toward the end plate falls within a periphery of the recess.

In some embodiments, magnet flux emitted from one end of one of the at least one pair of magnet assemblies pass through one side of the coil and arrive at an end of the other of the at least one pair of magnet assemblies in one direction parallel to the axial direction, and magnet flux emitted from the other end of the other of the at least one pair of magnet assemblies pass through the other side of the coil and arrives at the other end of the one of the at least one pair of magnet assemblies in another direction reverse to said one direction.

In some embodiments, each of the magnet assemblies comprises a main magnet, a first auxiliary magnet and a second auxiliary magnet, the first auxiliary magnet and the second auxiliary magnet being respectively attached to opposite sides of the main magnet in the vibrating direction and facing opposite two sides of the coil in the axial direction.

In some embodiments, a magnetization direction of the main magnet is parallel to the vibrating direction, and magnetization directions of the first auxiliary magnet and the second auxiliary magnet are perpendicular to the vibrating direction.

Compared with the related art, in the vibration sounding device of the present disclosure, one of the cover and the housing contacts with and is fixed to the screen of a mobile terminal device, and the other of the cover and the housing is fixed to the casing of the mobile terminal device. The coil assembly and the magnet assembly are respectively fixed to the cover and the housing. When the coil assembly is energized, the energized coil assembly interacts with the magnet assembly to generate an electromagnetic driving force which directly drives the cover and the screen to vibrate and sound. The above structure can obtain a flatter electromagnetic driving force and a stable driving force output, and reduce assembly requirements. The magnetic suction force between the panel and the magnet assembly is balanced and the requirements on the panel are reduced. The vibration sounding device of the present disclosure is applicable to panels of different types of screens. The side wall of the housing and the first and second auxiliary magnets reduce the magnetic leakage of the magnetic field. Thus, a magnet field with high usage efficiency is achieved and interference of the magnet field with other components is avoided. The attenuation of the high frequency performance is reduced and the acoustic performance of the acoustic screens is improved.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

DESCRIPTION OF THE EMBODIMENTS

Figure 1:
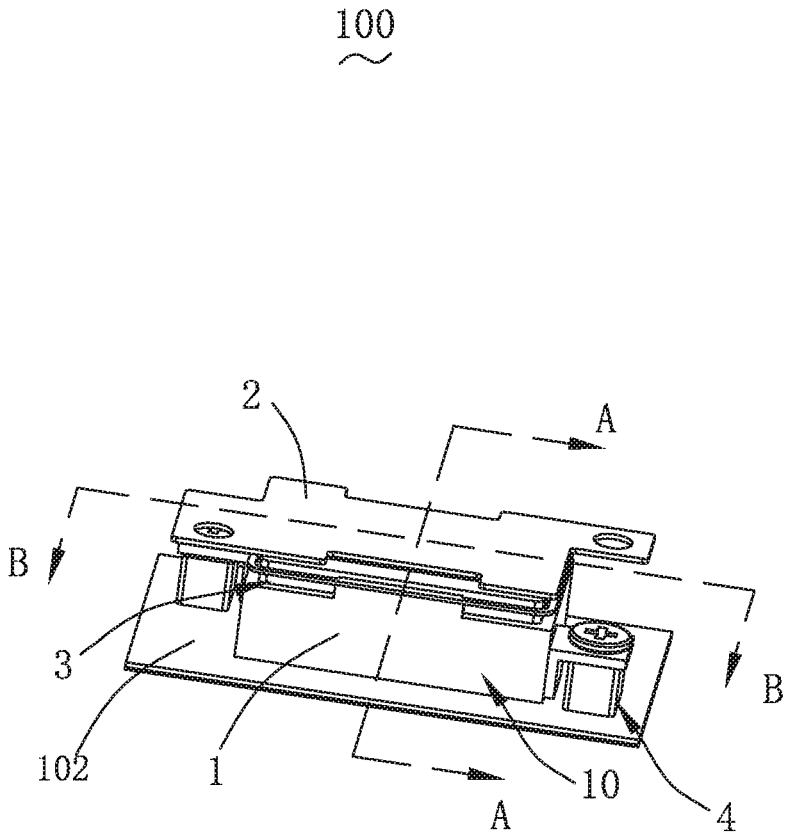
FIG. 1 illustrates a vibration sounding device in accordance with an exemplary embodiment of the present disclosure.
Figure 2:
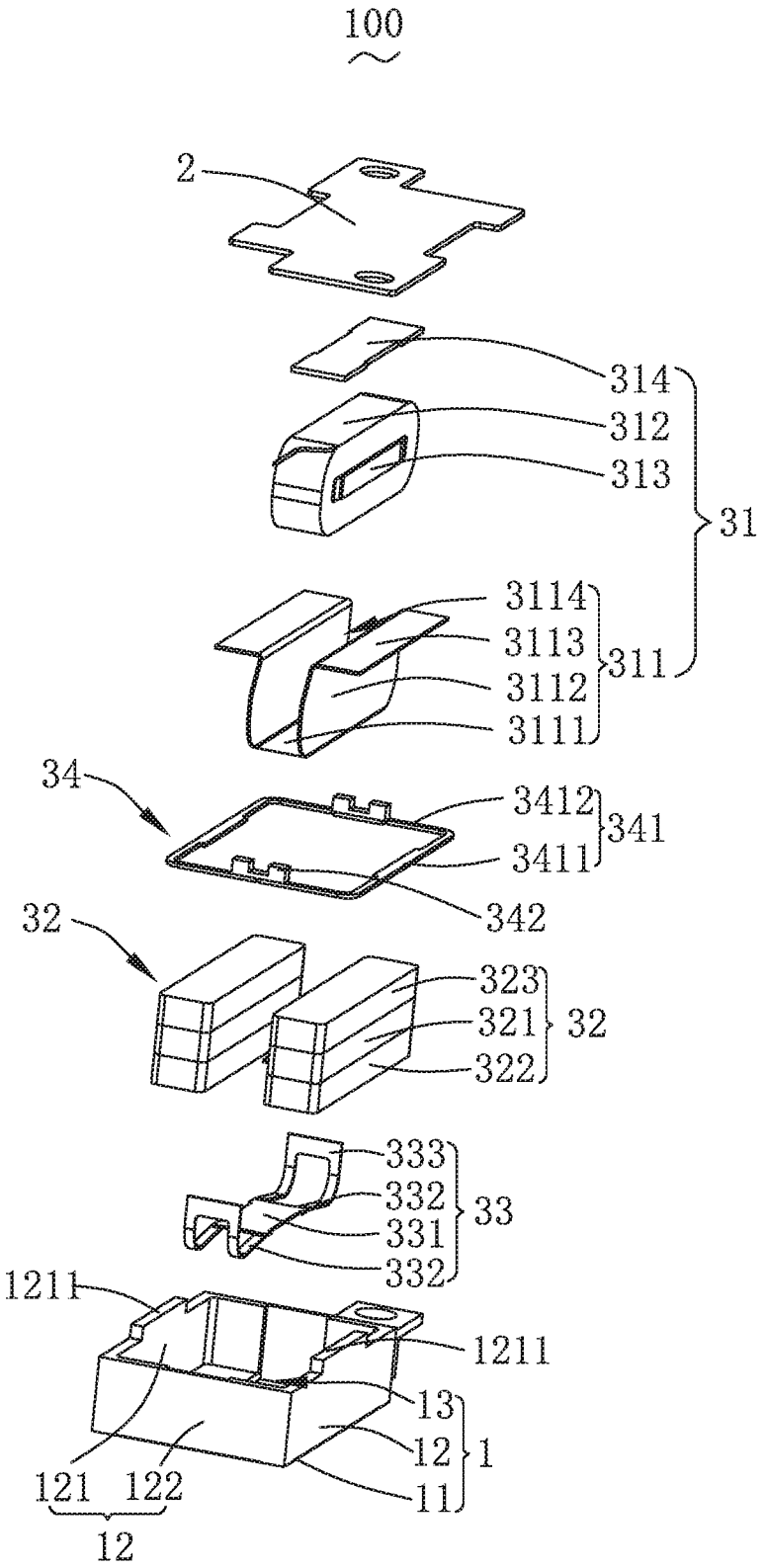
FIG. 2 is a partly exploded view of a vibration sounding device according to an exemplary embodiment of the present disclosure.

The present disclosure will be further illustrated with reference to the accompanying drawings. It shall be noted that the elements of similar structures or functions are represented by like reference numerals throughout the figures. The embodiments described herein are not intended as an exhaustive illustration or description of various other embodiments or as a limitation on the scope of the claims or the scope of some other embodiments that are apparent to one of ordinary skills in the art in view of the embodiments described in the Application. In addition, an illustrated embodiment need not have all the aspects or advantages shown.

Refer to FIGS. 1-4, a vibration sounding device 100 in accordance with an exemplary embodiment of the present disclosure comprises a panel 102 and an electromagnetic driver 10 configured for driving the panel 20 to vibrate in a vibrating direction and sound. In this embodiment, the panel 102 is a panel of a screen of a mobile terminal device such as a mobile phone.

The electromagnetic driver 10 comprises a housing 1, a cover 2 spaced from the housing 1, and a driving unit 3 arranged between the housing 1 and the cover 2. Specifically, the driving unit 3 is received in the housing 1 and covered by the cover 2. The cover 2 is capable of vibrating relative to the housing 1. One of the housing 1 and the cover 2 is fixed to the panel 102. In this embodiment, the housing 1 is fixed to the panel 102 via fasteners 4.

In this embodiment, the housing 1 comprises an end plate 11 facing the cover 2 and a side wall 12 extending from the periphery of the end plate 211 toward the cover 2. The side wall 12 is spaced from the cover 2. A recess 13 is formed in a surface of the end plate 11 facing the cover 22. The recess 13 extends from the surface of the end plate 11 in a direction away from the cover 22.

Specifically, the end plate 11 has a rectangular configuration. The side wall 12 comprises a pair of first side plates 121 spaced from each other and a pair of second side plates 122 spaced from each other and respectively connected between the first side plates 121. The recess 13 extends from one of the second side plates 122 to the other of the second side plates 122.

The driving unit 3 comprises a coil assembly 31, a magnet assembly 32, a first elastic member 33 and a second elastic member 34.

The coil assembly 31 is fixed to the cover 2 and spaced from the housing 1. The coil assembly 31 defines an axial direction perpendicular to the vibrating direction.

The magnet assembly 32 is fixed to the housing 1 with a gap formed between the coil assembly 31 and the magnet assembly 32 in the axial direction. In the embodiment, the driving unit 3 comprises a pair of magnet assemblies 32 fixed to the end plate 11 and respectively located at opposite sides of the recess 13. The coil assembly 31 is disposed between the pair of magnet assemblies 32 in the axial direction of the coil assembly 31 with axial gaps formed between the coil assembly 31 and the magnet assemblies 32 such that the coil assembly 31 is moveable relative to the magnet assemblies 32 in the vibrating direction when the coil assembly 31 is energized.

The second elastic member 34 is connected with the cover 2 and the housing 1 and configured to provide an elastic support for the cover 2 in the vibrating direction.

The first elastic member 33 is configured to support the coil assembly 31 on the housing 1. The first elastic member 33 is fixed between the coil assembly 31 and the housing 1 and configured to provide an elastic supporting force for the coil assembly 31 in the vibrating direction.

When the coil assembly 31 is energized, the coil assembly 31 generates an electromagnetic field which interacts with the permanent magnet field generated by the magnet assemblies 32 to thereby drive the coil assembly 31 to reciprocate in the vibrating direction which is a relatively linear direction, that is, the magnet assembly 32 drives the energized coil assembly 31 to vibrate reciprocatingly, thereby driving the panel 20 to vibrate and sound.

In the embodiment, the coil assembly 31 and the cover 2 are connected together and the combined coil assembly 31 and cover 2 are elastically supported in the housing 1 by the second elastic member 34 and the first elastic member 33 so that the electromagnetic driver 10 forms an integral structure which ensures the relative position of the XYZ three directions between the assembly formed by the cover 2 and coil assembly 31 and the assembly formed by the housing 1 and the magnet assembly 32. The coil assembly 31 has only a single Z-direction degree of freedom when energized. That is, the coil assembly 31 has only a single degree of freedom in the vibrating direction, which prevents the assembly formed by the cover 2 and coil assembly 31 and the assembly formed by the housing 1 and the magnet assembly 32 from swaying relative to each other, thereby improving reliability and stability of the vibration sounding device 100. The acoustic effect of the vibration sounding device 100 is improved.

Specifically, the coil assembly 31 comprises a mounting member 311, a coil 312, an iron core 313 and a clamping member 314.

The mounting member 311 comprises a bottom plate 3111, a pair of side walls 3112 respectively extending from opposite sides, facing the magnetic member assemblies 32, of the bottom plate 3111, and a pair of top walls 3113 extending in opposite directions from top ends of the side walls 3112 away from the bottom plate 3111. The bottom plate 3111 and the side walls 3112 cooperatively form a receiving space 3114. The top walls 3113 contact with the cover 2 and are fixed to the cover 2. The coil 312 and the magnetic core 313 are received in the receiving space 3114.

The coil 312 is fixed in the receiving space 3114 and the coil 32 is wound around the axial direction which is perpendicular to the vibrating direction. In the present invention, the first side pate 121 is perpendicular to the axial direction of the coil 32. The orthographic projection of the coil 312 in the vibrating direction toward the end plate 11 completely falls within the periphery of the recess 13. The recess 13 provides a space for vibration of the coil 312, preventing the coil 312 form bumping against the end plate 11 to generate noise during vibration, which further improves the acoustic effect of the sound generated by vibration of the screen.

In order to increase the driving force of the driving unit 3, the coil 312 is wound on the iron core 313 to form an electromagnet structure which interacts with the magnet assemblies 32 to generate an increased driving force.

The clamping member 314 interposed between the coil 312 and the cover 2 is made of magnet conductive material and configured to conduct magnetic flux and reduce magnetic leakage, thereby further increasing the driving force of the driving unit 3.

Each of the magnet assembly 32 includes a main magnet 321 and a first auxiliary magnet 322 and a second auxiliary magnet 323 which are attached to opposite sides of the main magnet 321 in a direction parallel to the vibrating direction.

Figure 3:
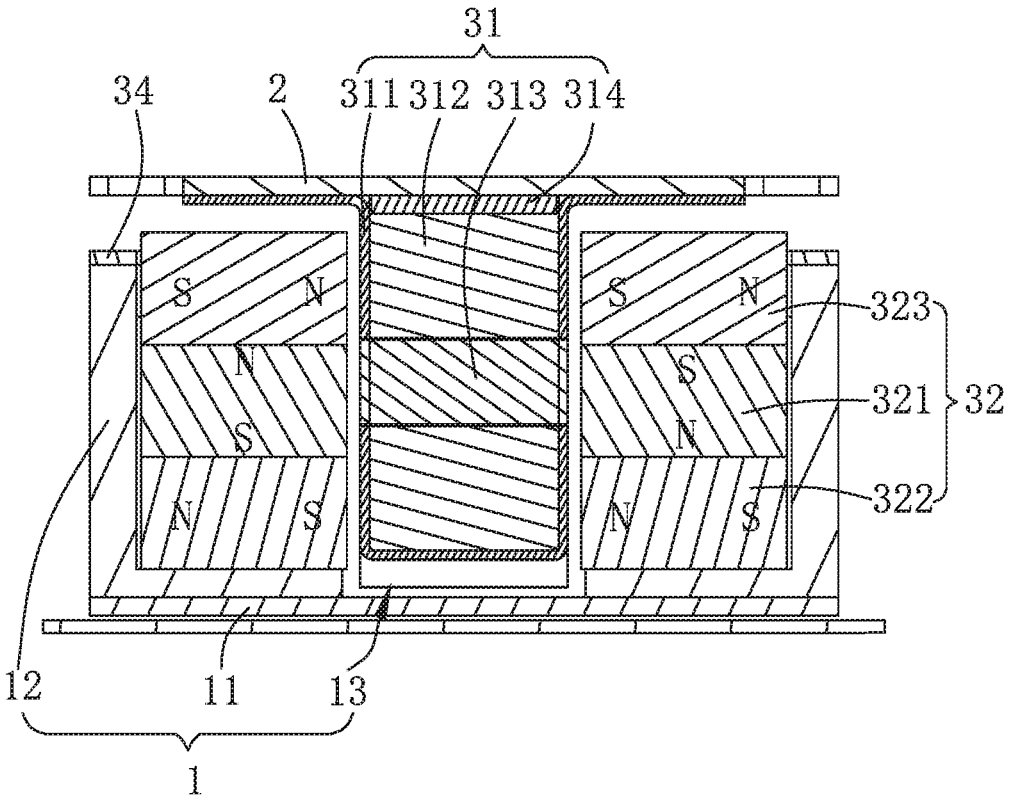
FIG. 3 is a cross-sectional view taken along line A-A of FIG. 1.
Figure 4:
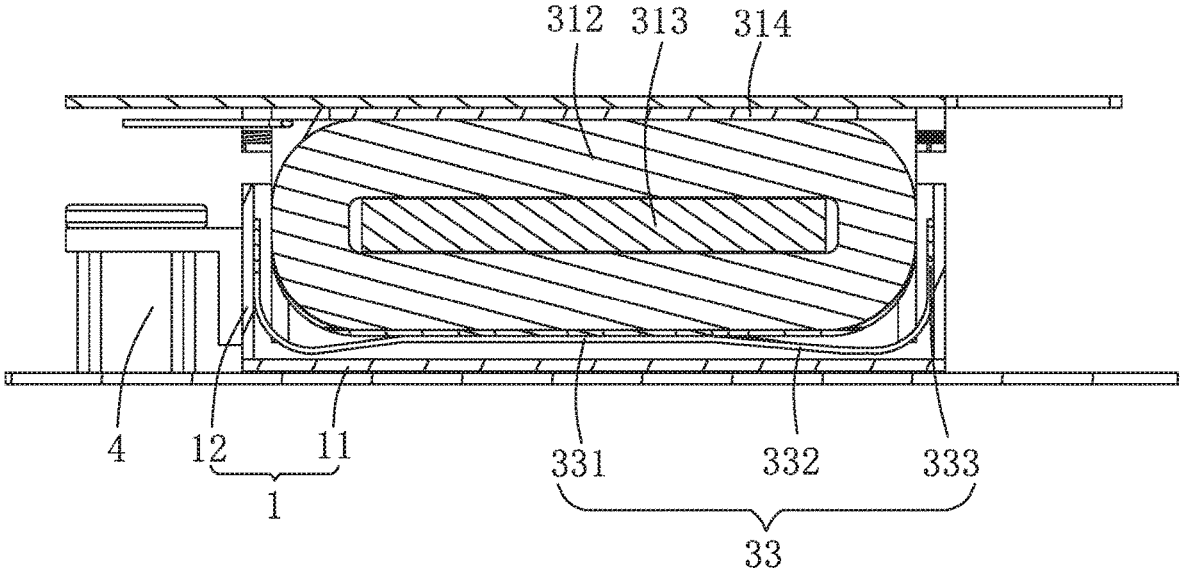
FIG. 4 is a cross-sectional view taken along line B-B of FIG. 1.

The magnetization direction of the main magnet 321 is parallel to the vibrating direction, and the magnetization directions of the two main magnets 321 of the two magnet assemblies 32 are opposite to each other. For example, as shown in FIG. 3, the end of the left main magnet 321 facing the cover 22 is a north pole and the end of the left main magnet 321 facing the end plate 211 is a south pole. The end of the right main magnet 321 facing the cover 22 is a south pole, and the end of the right main magnet 321 facing the end plate 211 is a north pole.

The first auxiliary magnet 322 is fixed to the housing 1, for example, the first auxiliary magnet 322 is fixed to the end plate 11 of the housing 1. The second auxiliary magnet 323 is spaced apart from the cover 2.

The magnetization directions of the first auxiliary magnet 322 and the second auxiliary magnet 323 are both perpendicular to the vibrating direction and parallel to the axial direction of the coil 312. The first auxiliary magnets 322 and the second auxiliary magnets 323 respectively face upper and lower parts of the coil 312 in the axial direction of the coil 312.

The ends of the first auxiliary magnet 322 and the second auxiliary magnet 323 of the same magnet assembly 32 facing the coil assembly 31 have opposite polarity. For example, in the same magnet assembly 32, the end of the first auxiliary magnet 322 facing the coil assembly 31 is a south pole, and the end of the first auxiliary magnet 322 away from the coil assembly 31 is a north pole. The end of the second auxiliary magnet 323 facing the coil assembly 31 is a north pole, and the end of the second auxiliary magnet 323 away from the coil assembly 31 is a south pole.

Two ends of the first auxiliary magnet 322 of the two magnet assemblies 32 facing the coil assembly 31 have opposite polarity. For example, as shown in FIG. 3, in the two first auxiliary magnet 322 of the two magnet assemblies 32 located on opposite left and right sides of the coil assembly 31, the end of the first auxiliary magnet 322 on the left side of the coil assembly 31 facing the coil assembly 31 is a south pole, and the end of the first auxiliary magnet 322 on the left side of the coil assembly 31 away from the coil assembly 31 is a north pole. The end of the first auxiliary magnet 322 on the right side of the coil assembly 31 facing the coil assembly 31 is a north pole, and the end of the first auxiliary magnet 322 on the right side of the coil assembly 31 away from the coil assembly 31 is a south pole.

Two ends of the second auxiliary magnet 323 of the two magnet assemblies 32 facing the coil assembly 31 have opposite polarity. For example, as shown in FIG. 3, in the two second auxiliary magnet 323 of the two magnet assemblies 32 located on opposite left and right sides of the coil assembly 31, the end of the second auxiliary magnet 323 on the left side of the coil assembly 31 facing the coil assembly 31 is a north pole, and the end of the second auxiliary magnet 323 on the left side of the coil assembly 31 away from the coil assembly 31 is a south pole. The end of the second auxiliary magnet 323 on the right side of the coil assembly 31 facing the coil assembly 31 is a south pole, and the end of the second auxiliary magnet 323 on the right side of the coil assembly 31 away from the coil assembly 31 is a north pole.

The first auxiliary magnets 322 and the second auxiliary magnets 323 are configured to conduct magnetic flux from the north pole of one of the main magnets 321 to pass through one part of the coil and back to the south pole of the other of the main magnets 321, and conduct magnetic flux from the north pole of the other of the main magnets 321 to pass through the other part of the coil 312 and back to the south pole of the one of the main magnets 321. As shown in FIG. 3, the second auxiliary magnets 323 cooperatively conduct magnetic flux emitted from the north pole of the main magnet 321 located on the left side of the coil assembly 31 to pass through the upper part of the coil 312 and back to the south pole of the main magnet 321 located on the right side of the coil assembly 31, and the first auxiliary magnets 322 cooperatively conduct magnetic flux emitted from the north pole of the main magnet 321 located on the right side of the coil assembly 31 to pass through the lower part of the coil 312 and back to the south pole of the main magnet 321 located on the left side of the coil assembly 31.

The side wall 12 made of magnetic conductive material is capable of reducing magnetic leakage of the magnetic field formed by the magnet assembly 32 and the coil assembly 31, thereby improving usage efficiency of the magnetic field, increasing the driving force of the electromagnetic driver 10 and improving the acoustic effect of sound generated by vibration of the panel.

The above-mentioned magnet assembly 32 can obtain a more flat magnetic field driving force and a more stable driving force output, and reduce assembly requirements without excessive attenuation of high-frequency performance when the coil assembly 31 has no core 313. At the same time, the magnetic suction force between the magnet assembles 32 and the assembly formed by the cover 2 and the coil assembly 31 is balanced. The requirements on the panel 102 are therefore reduced and the sound vibrating device is suitable for different types of screens such as OLED hard screen, soft screen and LCD. The reliability of the sound vibrating device is improved. The magnetic circuit of the magnet assemblies 32 can be split or not split according to different application scenarios. The side wall 12 of the housing 1 and the first auxiliary magnet 322 and the second auxiliary magnet 323 cooperate to reduce magnetic leakage, thereby achieving a high usage efficiency magnetic field and avoiding interfering with other components of the mobile terminal device.

When the above-mentioned magnet assemblies 32 are used with the coil assembly 31 which has the iron core 313, magnetic flux emitted from one of the first auxiliary magnet 322 and the second auxiliary magnet 323 in the same magnet component 32 pass through one side of the coil 312 and arrive at the other one of the first auxiliary magnet 322 and the second auxiliary magnet 323 after passing through the other side of the coil 312. When the coil 312 is supplied with alternating current, the energized coil 312 interacts with the magnet field generated by the magnet assembly 32 to generate a first driving force in the vibrating direction. After the coil 312 is energized, the iron core 313 produces an electromagnet effect and becomes an electromagnet with south and north polarities in the axial direction of the coil 312 which is perpendicular to the vibrating direction. A second driving force in the vibrating direction is generated between the core 313 and the magnet assemblies 32. The first driving force and the second driving force are superimposed. The usage efficiency of the magnetic field is further increased and the acoustic effect of sound generated by vibration of the panel is further improved.

More preferably, the surface of the core 232 is plated with copper or a copper ring is attached to the surface of the core 232 to form a short-circuit ring which facilitates to solve the problem of attenuation of high frequency performance. When the driving unit 3 applies the iron core, a higher magnetic field driving force can be obtained and thus a higher output driving force can be obtained. The high frequency performance is partially attenuated due to the effect of the core 232 and the short-circuit ring can effectively reduce attenuation of the high frequency performance.

The second elastic member 34 includes a first elastic frame 341 and a connecting part 342. Preferably, the first elastic frame 341 is ring-shaped and includes two first elastic arms 3411 arranged oppositely and two second spaced elastic arms 3412 connected between ends of the two first elastic arms 3411. The two first elastic arms 3411 are supported and fixed on opposite sides of the housing 1, for example, supported on the side wall 12 of the housing 1. More preferably, the first elastic arms 3411 are parallel to the top walls 3113 of the mounting member 311.

In the embodiment, portions of the side wall 12 protrude toward the cover 2 to form support protrusion 1211, and the first elastic arm 3411 is supported on the support protrusion 1211 to provide a reliable vibration space and maintain good stability and reliability.

One connecting part 342 is disposed on the side of each of the two second elastic arms 3412 away from the housing 1. The second elastic arms 3412 are fixed to the cover 2 through the connecting parts 342 to thereby support the cover 2 on the housing 1 and provide an elastic support force for the cover 2 in the vibration direction.

The orthographic projection of the first elastic member 33 along the vibrating direction toward the end plate 11 completely falls within the periphery of the recess 13. Specifically, the first elastic member 33 has a U-shaped configuration and includes a first fixing arm 331 fixed to a side of the coil assembly 31 away from the cover 2, a pair of second fixing arms 333 fixed to the housing 1, and elastic connecting arms 332 connected between the first fixing arm 331 and the second fixing arm 333. The Elastic connecting arms 332 are suspended and spaced from the end plate 11. The projections of the elastic connecting arms 332 in the vibrating direction and the projection of the magnet assembly 32 in the vibrating direction are spaced from each other. The second fixing arms 333 are fixed to the side wall 12. In the embodiment, the second fixing arms 333 are fixed to the second side plates 122 respectively. More preferably, the second fixing arms 333 and the second elastic arm 3412 are aligned with and spaced from each other. Specifically, the first fixing arm 331 is fixed to a side of the bottom plate 3111 of the mounting member 311 away from the coil 312. The first fixing arm 331 may be fixed to the bottom surface of the bottom plate 3111 by adhesive or other mechanical connecting means. Thus, the first elastic member 33 supports the coil assembly 31 which is suspended in the housing 1 and the first elastic member 33 provides an elastic supporting force for the coil assembly 31 in the vibrating direction.

In the above structure, the coil assembly 31 and the cover 2 are connected together and the combined coil assembly 31 and cover 2 are elastically supported in the housing 1 by the second elastic member 34 and the first elastic member 33 so that the electromagnetic driver 10 forms an integral structure which ensures the relative position of the XYZ three directions between the assembly formed by the cover 2 and coil assembly 31 and the assembly formed by the housing 1 and the magnet assembly 32. The coil assembly 31 has only a single Z-direction degree of freedom when energized. That is, the coil assembly 31 has only a single degree of freedom in the vibrating direction, which prevents the assembly formed by the cover 2 and coil assembly 31 and the assembly formed by the housing 1 and the magnet assembly 32 from swaying relative to each other, thereby improving reliability and stability of the vibration sounding device 100. The acoustic effect of the vibration sounding device 100 is improved.

The present disclosure further provides a vibration sounding device of another embodiment, which is basically the same as the above embodiment, except that the mounting member has a different configuration as described below.

Figure 5:
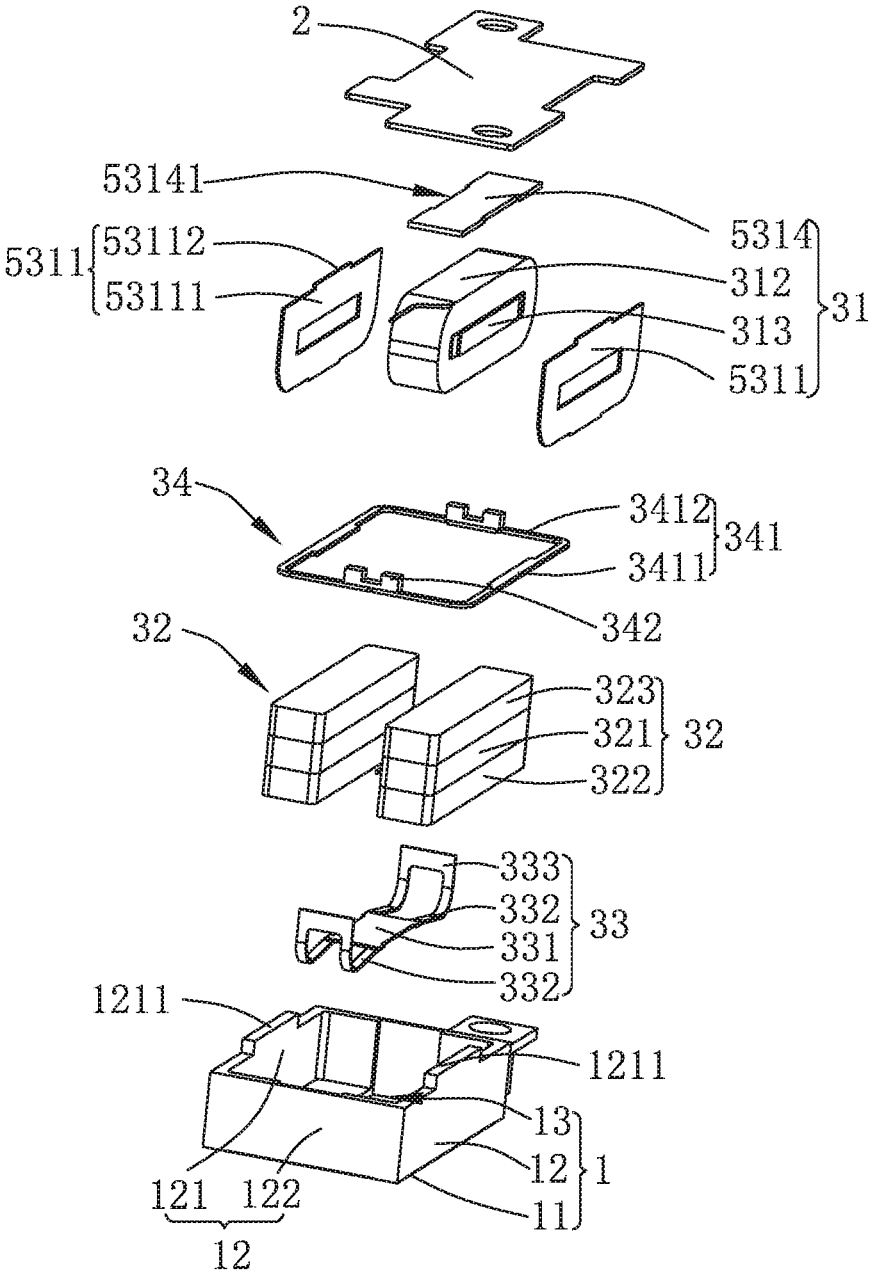
FIG. 5 is a partly exploded view of a vibration sounding device according to an alternative embodiment of the present disclosure.

Referring to FIG. 5, the mounting member 5311 includes a pair of fixing plates 53111 fixed to opposite sides of the coil 312 facing the magnet assemblies 32 and fixing protrusions 53112 extending from the fixing plates 53111 toward the cover 2. Cutouts 53141 are formed in opposite sides of the clamping member 5314, and the fixing protrusions 53112 are respectively engaged in the cutouts 53141 and fixed to the cover 2. Correspondingly, the first fixing arm 331 of the first elastic member 33 is fixed to a side of the coil 312 away from the cover 2.

Compared with the related art, in the vibration sounding device of the present disclosure, one of the cover and the housing contacts with and is fixed to the screen, the other is fixed to a casing of the mobile terminal. The coil assembly and the magnet assembly are respectively fixed to the cover and the housing. When the coil assembly is energized, the energized coil assembly interacts with the magnet assembly to generate an electromagnetic driving force which directly drives the cover and the panel to vibrate and sound. The above structure can obtain a flatter electromagnetic driving force and a stable driving force output, and reduce assembly requirements. The magnetic suction force between the panel and the magnet assembly is balanced and the requirements on the panel are reduced. The vibration sounding device of the present disclosure is applicable to panels of different types of screens. The side wall of the housing and the first and second auxiliary magnets reduce the magnetic leakage of the magnetic circuit low. Thus, a magnet field with high usage efficiency is achieved and interference of the magnet field with other components is avoided. The attenuation of the high frequency performance is reduced and the acoustic performance of the acoustic screens is improved.

The above-described are only embodiments of the present disclosure. It shall be noted that those skilled in the art may make improvements without departing from the spirit or scope of the present disclosure. All these improvements fall into the protection scope of the present disclosure.

What is claimed is:

1. A vibration sounding device comprising:

a panel; and an electromagnetic driver attached to the panel and configured to drive the panel to vibrate in a vibrating direction and sound, the electromagnetic driver comprising a housing, a driving unit disposed in the housing, and a cover covering the driving unit, one of the housing and the cover being attached to the panel;

wherein the driving unit comprises a coil assembly mounted to the cover and at least one pair of magnet assemblies mounted to the housing, the coil assembly comprising a coil defining an axial direction around which the coil is wound, the at least one pair of magnet assemblies being located at opposite sides of the coil assembly with gaps formed therebetween in the axial direction; and wherein the electromagnetic driver comprises a first elastic member configured to support the coil assembly in the housing, the first elastic member being connected between the coil assembly and the housing and configured to provide an elastic supporting force for the coil assembly.

2. The vibration sounding device of claim 1, wherein the housing comprises a bottom plate and a side wall extending from the bottom plate toward the cover and around the driving unit, and the first elastic member comprises a first fixing arm attached to the coil assembly, a second fixing arm attached to the side wall and an elastic connecting arm connected between the first fixing arm and the second fixing arm, the elastic connecting arm being spaced from the bottom plate in the vibrating direction.

3. The vibration sounding device of claim 2, wherein an orthographic projection of the elastic connecting arm in the vibrating direction is spaced from an orthographic projection of the magnet assembly in the vibrating direction.

4. The vibration sounding device of claim 2, wherein the first elastic member is U-shaped.

5. The vibration sounding device of claim 2, wherein the electromagnetic driver further comprises a second elastic member connected the cover with the housing, the second elastic member comprising a frame and connecting parts, the frame comprising a pair of first elastic arms facing each other and a pair of second elastic arms connected between ends of the first elastic arms, the first elastic arms mounted on opposite sides of the housing, at least one of the connecting parts being arranged on a side of each of the second elastic arms away from the housing, the second elastic arms being secured to the cover via the connecting parts.

6. The vibration sounding device of claim 5, wherein a surface of the bottom plate facing the cover defines a recess which is sunk from the surface in a direction away from the cover, the second fixing arm being attached to a surface of the side wall facing the coil assembly, the magnet assembly being mounted on the bottom plate and located at opposite sides of the recess, an orthographic projection of the coil on the bottom plate in the vibrating direction falling within a periphery of the recess.

7. The vibration sounding device of claim 5, wherein portions of the side wall protrude toward the cover to form a pair of support parts, and the first elastic arms are supported and fixed on the support parts respectively.

8. The vibration sounding device of claim 5, wherein the coil assembly further comprises a mounting member configured to mount the coil to the cover and a clamping member disposed between the coil and the cover.

9. The vibration sounding device of claim 8, wherein the mounting member comprises a bottom plate, a pair of side walls extending from opposite sides, adjacent to the magnet assemblies, of the bottom plate toward the cover, and a pair of top walls extending in opposite directions from top ends of the side walls away from the bottom plate, the bottom plate and the side walls cooperatively forming a receiving space, the top walls contacting and being fixed to the cover, the coil being fixed in the receiving space, the first fixing arm being fixed to a side of the bottom plate away from the coil.

10. The vibration sounding device of claim 8, wherein the mounting member comprises a pair of fixing plates fixed to opposite sides of the coil close to the magnet assemblies and fixing protrusions extending from the fixing plates toward the cover, cutouts are formed in opposite sides of the clamping member, and the fixing protrusions are respectively engaged in the cutouts and fixed to the cover.

11. The vibration sounding device of claim 6, wherein the end plate has a rectangular shape, the side wall comprises a pair of first side plates and a pair of second side plates connected between the first side plates, the recess extending from one of the second side plates to the other of the second side plates, an orthographic projection of the first elastic member in the vibrating direction toward the end plate falls within a periphery of the recess.

12. The vibration sounding device of claim 1, wherein the coil comprises opposite two parts in the vibrating direction, magnet flux emitted from one end of one of the at least one pair of magnet assemblies pass through one of the two parts of the coil and arrive at an end of the other of the at least one pair of magnet assemblies in one direction parallel to the axial direction, and magnet flux emitted from the other end of the other of the at least one pair of magnet assemblies pass through the other of the two parts of the coil and arrives at the other end of the one of the at least one pair of magnet assemblies in another direction reverse to said one direction.

13. The vibration sounding device of claim 1, wherein each of the magnet assemblies comprises a main magnet, a first auxiliary magnet and a second auxiliary magnet, the first auxiliary magnet and the second auxiliary magnet being respectively attached to opposite sides of the main magnet in the vibrating direction and facing opposite two parts of the coil in the axial direction, a magnetization direction of the main magnet being parallel to the vibrating direction, and magnetization directions of the first auxiliary magnet and the second auxiliary magnet being perpendicular to the vibrating direction.

14. The vibration sounding device of claim 1, wherein the axial direction is perpendicular to the vibrating direction.

15. The vibration sounding device of claim 1, wherein the coil assembly further comprises an iron core and the coil is wound on the iron core.

16. The vibration sounding device of claim 1, wherein the coil assembly further comprises a clamping member arranged between the cover and the coil.

* * * * *